US005694840A

United States Patent [19]

Isozaki et al.

[11] Patent Number: 5,694,840

[45] Date of Patent: *Dec. 9, 1997

[54] PRINTING IMAGE AFTER-PROCESSING APPARATUS

[75] Inventors: Takashi Isozaki; Sadanao Okuda; Takahito Tojima, all of Tokyo, Japan

[73] Assignee: Riso Kagaku Corporation, Tokyo, Japan

[ * ] Notice: The term of this patent shall not extend beyond the expiration date of Pat. No. 5,476,034.

[21] Appl. No.: 543,936

[22] Filed: Oct. 17, 1995

[30] Foreign Application Priority Data

Oct. 26, 1994 [JP] Japan ..... 6-262677

[51] Int. Cl.[6] ..... B41L 13/04

[52] U.S. Cl. ..... 101/116; 101/416.1; 101/424.2

[58] Field of Search ..... 101/116, 424.2, 101/424.1, 424, 416.1

[56] References Cited

FOREIGN PATENT DOCUMENTS

| | | |
|---|---|---|
| 2721323 | 10/1978 | Germany . |
| 3321681 | 12/1984 | Germany . |
| 58-024454 | 4/1983 | Japan . |
| 58-072457 | 4/1983 | Japan . |
| 60-250986 | 12/1985 | Japan . |
| 01018944 | 9/1989 | Japan . |
| 05169791 | 7/1993 | Japan . |
| 331554 | 7/1930 | United Kingdom . |

*Primary Examiner*—Edgar S. Burr
*Assistant Examiner*—Anthony H. Nguyen
*Attorney, Agent, or Firm*—Kanesaka & Takeuchi

[57] ABSTRACT

A printed image after-processing apparatus is formed of a contact member which is coated with an excess ink removing solution which is incompatible with the printing ink forming a printed image and has a lower surface tension than the printing ink, and driven to rotate the contact member having coefficient of dynamic friction with 1.5 or less; a counter member holding to convey printed paper between it and the contact member, to thereby bring the printed surface of the printed paper into contact with the excess ink removing solution on the contact surface: a supplying device for supplying the excess ink removing solution to the contact member; and a cleaning device which contacts the contact member.

5 Claims, 4 Drawing Sheets

FIG. 4

| | Excess ink removing performance |
|---|---|
| Example 1 | ○ |
| Example 2 | ○ |
| Example 3 | ○ |
| Example 4 | ○ |
| Example 5 | ○ |
| Comparison Example | × |
| Comparison Example | × |

PRINTING IMAGE AFTER-PROCESSING APPARATUS

BACKGROUND OF THE INVENTION

The present invention relates to a printed image after-processing apparatus to be used in a stencil printing machine. The present invention is particularly effective for preventing ink offset and strike-through in prints.

In printing using liquid printing ink, there sometimes occur such disadvantages as offsetting of ink caused by transfer of ink from the surface of a freshly printed sheet to the back of the sheet placed on top of it immediately after printing, and distortion of a printed image resulting just from lightly rubbing a printed image side by a fingertip immediately after printing; and further there will sometimes occur such a problem as the strike-through that ink forming the printed image penetrates a printed paper to its back side.

These problems are noticeable particularly in stencil printing which requires a large amount of ink for forming an image on a printing paper, that is, a large amount of ink transferred to the printing paper, as compared with other printing.

In a conventional printed image after-processing apparatus, an attempt has been made to reduce the amount of ink to be transferred to the printing paper in the printing process for the purpose of preventing offset and strike-through. However, it is hard to quantitatively control the amount of ink; excessive restriction of the amount of ink will result in an inadequate ink supply and accordingly in a dimmed image, thus deteriorating the quality of the printed image.

Furthermore, as a means for obviating the above-described problems, the use of a means for heating to dry ink transferred to form an image is also considered. In this case, however, it becomes necessary to use a heater having a substantially large heating capacity. When such an ink drying means as a heater is adopted to dry the print, as the printing speed of a printing machine increases, conditions to be imposed on the drying means become harder. Actually, it is impossible to dry ink at such a high rate that the offsetting and strike-through can be prevented.

In some printing systems, fine powder or dust of starch, talc, etc. is applied over a printed image side to prevent offsetting. However, such a fine-dust applying device uses compressed air, which needs a considerably large space for mounting the compressed air in the printing machine.

After completion of printing, when a printed paper is carried to a paper delivery tray, sorter, etc., a conveyor roller can not contact the printed image side of the printed paper in order to protect the printed image. In a prior art apparatus, the printed paper is carried by a conveying mechanism such as a belt conveyor which contacts only the back side (unprinted image side) of the printed paper. This type of printed paper conveying apparatus has been disclosed in Japanese Patent Laid-Open No. Sho 50-88769.

However, in the prior art conveying apparatus, if the printed paper is conveyed in contact only with the back side of paper, not in contact with the printed image side, paper edges can not be aligned properly, so that a deteriorated paper discharging performance will occur at a paper receiving section such as the delivery tray, sorter, etc. as compared with a copying apparatus such as PPC in which paper is held from both sides and conveyed forcefully. This tendency becomes more and more conspicuous with an increase in the printing speed, or in other words the paper discharge speed.

This problem tends to largely decrease the freedom of setting a paper discharging and conveying route in the printing machine.

Beside the above-described means, there has also been proposed a device of such a mechanism that excessive ink left on the roller is removed by a cleaning means such as a blade by rotating the roller in contact with the printed image side of the printed paper. The cleaning means such as the blade, however, will vibrate in the event the roller is in an unstable contact with the roller, failing in fully removing ink from the roller. In this case, ink is transferred from the roller back to the printed paper through the blade, smudging the printed image side.

In view of the above-described problems, the present invention has as its object the provision of a printed image after-processing apparatus which is capable of exactly preventing the occurrence of offsetting and strike-through without inducing other troubles, and removing excessive ink from the printed image side.

SUMMARY OF THE INVENTION

The printed image after-processing apparatus according to the first aspect of the present invention has a contact member which is coated with an excess ink removing solution incompatible with printing ink having a lower surface tension than the printing ink for forming the printed image, and is driven to rotate, the contact member having a 1.5 or lower coefficient of dynamic friction; a counter member for holding to carry a printed paper in association with the contact member to bring the printed side of the printed paper into contact with the excess ink removing solution on the contact member; a supply means for supplying the excess ink removing solution to the contact member; and a cleaning means which contacts the contact member.

In the printed image after-processing apparatus according to the second aspect of the present invention, the counter member in the printed image after-processing apparatus of the first aspect is a counter roller rotating oppositely to the contact member.

In the printed image after-processing apparatus according to the third aspect of the present invention, collecting means for collecting the excess ink removing solution is disposed adjacently to the contact section of the cleaning means which contacts the contact member, on the front side in relation to a direction of rotation of the contact member in the printed image after-processing apparatus stated in the second aspect.

In the printed image after-processing apparatus according to the fourth aspect of the present invention, the contact member in the printed image after-processing apparatus of the third aspect is a contact roller.

In the printed-image after-processing apparatus according to the fifth aspect of the present invention, the contact member in the printed image after-processing apparatus according to the third aspect of the invention is an endless belt wrapped on a plurality of roller members.

The excess ink removing solution held on the peripheral surface of the contact member contacts the printed image side of the printed paper. An excessive amount of the printing ink forming the printed image transfer to the excess ink removing solution on the contact member, and is removed from the printed body. The excess ink removing solution is a liquid incompatible with the printing ink which forms the printed image, and is lower in surface tension than the printing ink. Therefore, the excessive printing ink that has being removed to the excess ink removing solution is present afloat on the surface of the excess ink removing solution where ink is physically separate from the excess ink removing solution. This printing ink in a floating state is removed by the cleaning means which contacts the contact member. The cleaning means will not vibrate if the contact member rotates so long as the coefficient of dynamic friction of the contact member remains at 1.5 or lower. The excessive printing ink floating on the surface of the contact member is removed from the contact member by the cleaning means which comes into contact with the surface of the contact member with the rotation of the contact member.

All of the foregoing and still further objects and advantages of the present invention will become apparent from a study of the following specification, taken in connection with the accompanying drawings.

BRIEF DESCRIPTION OF THE DRAWINGS

FIG. 4 is a table showing a result of evaluation of ink removing performance of the apparatus of the present embodiment in comparison with compared examples.

DETAILED DESCRIPTION OF THE PREFERRED EMBODIMENT

Figure 1:
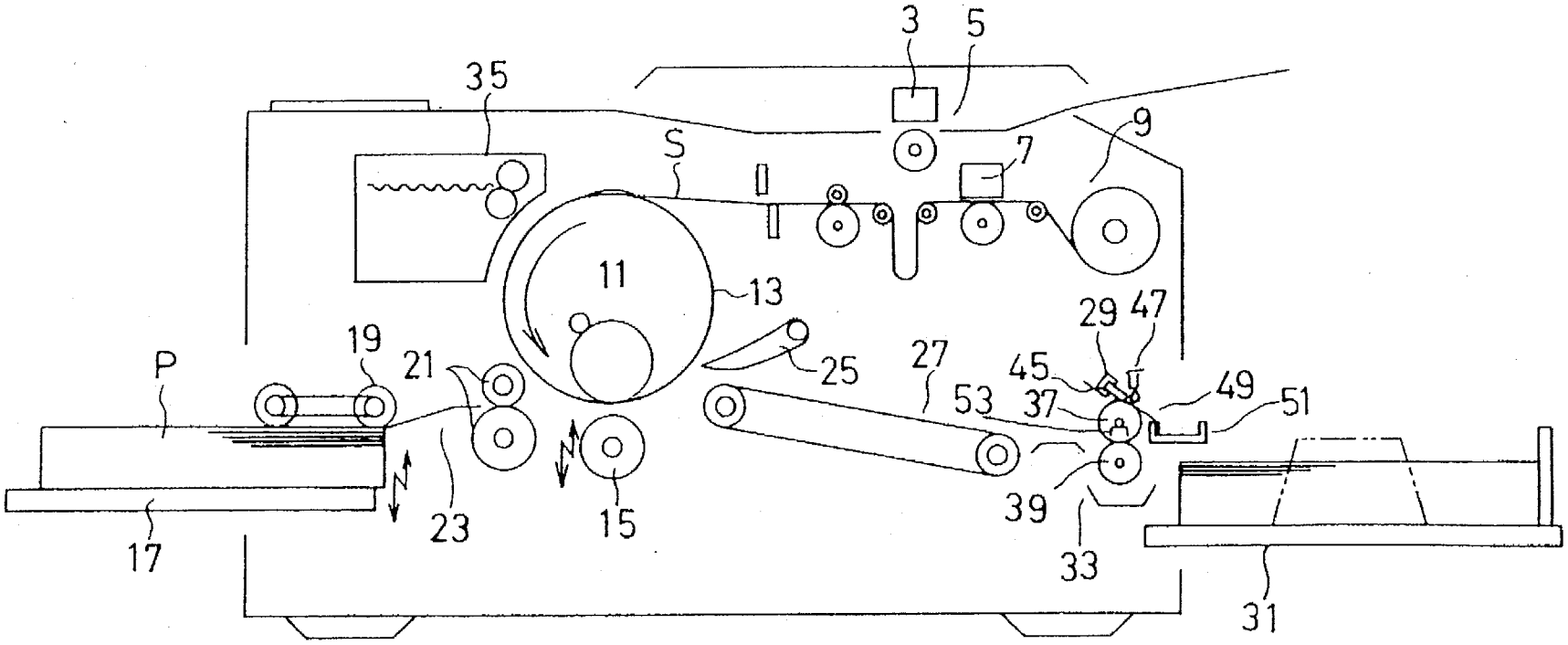
FIG. 1 is a view showing the constitution of one embodiment of a printed image after-processing apparatus of the present invention.

The construction of a stencil printing machine of a first embodiment will be explained with reference to FIGS. 1 and 2. An original image reading section 5 has an image scanner 3 whereby an original image to be printed is read. A perforating section 9 has a perforating device 7, which perforates an image in a stencil sheet in accordance with original image data read by the image reading section 5.

Around the outer peripheral surface of a cylindrical printing drum 13 a stencil sheet perforated at the perforating section 9 is wrapped. In the interior of the printing drum 13 is provided an ink supply device 11 inclusive of an ink sgueegee device, whereby ink is fed to the inner peripheral surface of the printing drum 13. Beneath the printing drum 13 is disposed an impression roller 15 which moves up and down. The impression roller 15 holds and transfer, a printing paper P to be fed between the printing drum 13 and the impression roller 15, thereby forming an image on the printing paper P.

In a paper feeding section 23 the printing paper P on the paper feed table 17 is fed out one by one by a paper feed roller 19, and is supplied by a paper feed timing roller 21 to the impression roller 15 and the printing drum 13.

In the paper discharge section 33, a stripping claw 25 strips printed paper from the printing drum 13. The printed paper P thus stripped is conveyed to a printed image after-processing apparatus 29 by means of a conveying device 27 of a belt-conveyor mechanism. The printed image after-processing apparatus 29 functions to remove excessive ink from the printed image on the printed paper P. The printed paper thus processed is discharged to a paper delivery table 31, where the printed paper is stacked.

The stencil sheet S after printing is stripped by a stencil discharge section 35 from the printing drum 13, and is discarded.

Printing operation in the above-described constitution will be explained as follows. The printing drum 13 is driven to rotate counterclockwise in the drawing about the axial center of itself by means of driving means (not shown). The printing paper P is carried from the left to the right in the drawing by a paper feed timing roller 21 at a specific timing in synchronization with the rotation of the printing drum 13, and is supplied between the printing drum 13 and the impression roller 15. The printed paper P is pressed by the impression roller 15 against the stencil sheet S wrapped around the outer peripheral surface of the printing drum 13 to thereby perform stencil printing.

The printed paper P is stripped from the printing drum 13 by means of the stripping claw 25, and sent, with the printed image side up, to the printed image after-processing apparatus 29 by the stencil sheet conveying device 27. The printed paper P is then conveyed toward the paper delivery table 31 while being after-processed by the printed image after-processing apparatus 29 and stacked on the paper delivery table 31.

Next, the constitution and operation of the printed image after-processing apparatus 29 will be explained. As shown in FIG. 2, the printed image after-processing apparatus 29 has a contact roller 37 as a contact member which contacts the printed image side (upper side) of the printed paper P after completion of printing, and a counter roller 39 as a counter member which is disposed oppositely to the contact roller 37. The contact roller 37 and the counter roller 39 are supported parallelly and rotated by driving means 30 through shafts 41 and 43 respectively. The counter roller 39 is pressed upward, that is, toward the contact roller 37, by a spring which is a pressing means not illustrated.

The outer peripheral surface 37*a* (the surface coated with the excess ink removing solution) of the contact roller 37 is in contact with a blade 45 which is a plate-like member having an approximately square section. The blade 45 is secured at the base end to the forward end of a sheet member, and at the forward end in contact with the contact roller 37. The blade 45 is mounted in an inclined position above the top of the contact roller, and the lower corner of the forward end is in contact with the outer peripheral surface 37*a* of the contact roller 37 at a position slightly before the top of the contact roller 37 in the direction of rotation.

Above the outer peripheral surface 37*a* of the contact roller 37, an excess ink removing solution supply nozzle 47 is disposed before the contact position, in the direction of rotation, between the blade 45 and the contact roller 37. The excess ink removing solution supply nozzle 47 is a supplying means for supplying the excess ink removing solution to the outer peripheral surface 37*a* of the contact roller 37. The excess ink removing solution is a liquid which is incompatible with the printing ink for forming a printed image and has a lower surface tension than the printing ink.

The excess ink removing solution supplied from the excess ink removing solution supply nozzle 47 to the outer peripheral surface 37*a* of the contact roller 37 gathers between the blade 45 and the contact roller 37 as illustrated. With the rotation of the contact roller 37, the excess ink removing solution passes between the contact roller 37 and the blade 45, and forms a layer thereof on the surface of the contact roller 37. At this time, the blade 45 has a function to form a uniform layer of the excess ink removing solution on the outer peripheral surface 37*a* of the contact roller 37. Furthermore, the blade 45 serves as a cleaning means to remove smudge from the outer peripheral surface 37*a* of the contact roller 37.

Before the blade 45 in the direction of rotation of the contact roller 37 there is provided a sheet-like elastic body 49 as an excess ink removing solution collecting means. The sheet-like elastic body 49 is a thin sheet-like member having specific elasticity. The forward end of the sheet-like elastic body 49 is in contact with the outer peripheral surface 37*a* of the contact roller 37 at a point of contact d located before the contact position between the blade 45 and the contact roller 37 in the direction of rotation of the contact roller 37. Furthermore, the sheet-like elastic body 49 is placed in a position closer to the contact roller 37 than to the tangent e of the contact roller 37 at the point of contact d, its rear end being positioned lower than the forward end. Therefore, a part of the sheet-like elastic body 49 near its forward end is in firm contact for a specific length with the outer peripheral surface 37*a* of the contact roller 37. Accordingly the sheet-like elastic body 49 in the part is elastically deflected along the shape of the outer peripheral surface 37*a* of the contact roller 37.

The rear end of the sheet-like elastic body 49 is secured to an excess ink removing solution receiving member 51 disposed below the point of contact d. The forward end of the sheet-like elastic body 49 is a free end, which is in contact with the contact roller 37 as previously stated. The sheet-like elastic body 49 is inclined so that it contacts the contact roller 37, at the forward end which is a free end, and that the fixed rear end is positioned below.

Next, operation of the printed image after-processing apparatus 29 of the above-described constitution will be explained. The printed paper P is conveyed and held between the contact roller 37 and the counter roller 39. A film a of an excess ink removing solution formed on the outer peripheral surface 37*a* of the contact roller 37 contacts the printed image side of the printed paper P. As a result of this contact, an excessive portion of the printing ink b forming the printed image on the printed paper P is transferred to the excess ink removing solution film a on the contact roller 37, thus removing the excessive ink from the printed paper P.

The printing ink c transferred to the film a of the excess ink removing solution on the contact roller 37 passes the sliding part of the sheet-like elastic body 49 and the contact roller 37 with the rotation of the contact roller 37.

The excess ink removing solution used in the present embodiment is a liquid which is incompatible with the printing ink b forming the printed image and has a lower surface tension than the printing ink c. As the film a of the excess ink removing solution on the contact roller 37 to which excessive printing ink c has been transferred is scraped off by the blade 45, there occurs an excess ink removing solution reservoir f including the printing ink c in a dispersed condition, before the blade 45 in the direction of rotation of the contact roller 37.

On the outer peripheral surface 37*a* of the contact roller 37 after the passage of the excessive printing ink through the blade 45, the film a of the excess ink removing solution including no printing ink c is regenerated. The contact roller 37 coated with the film a of the excess ink removing solution contacts again the printed image side of the printed paper P; and therefore the printed image side of the printed paper P is not smeared with the printing ink c transferred to the contact roller 37.

Since the contact position between the blade 45 and the outer peripheral surface 37*a* of the contact roller 37 is located before the top of the contact roller 37 in the direction of rotation, the excess ink removing solution in the excess ink removing solution reservoir f begins to flow with its own weight in the opposite direction of rotation of the contact roller 37 even when the contact roller 37 is rotating. This flow of the excess ink removing solution is guided to run along the inclined upper surface of the sheet-like elastic body 49 down into the receiving tray 51.

As the printed paper P passes between the contact roller 37 and the counter roller 39, an excessive portion of the printing ink b forming a printed image on the printed paper P moves over to the outer peripheral surface 37*a* of the contact roller 37. Furthermore, the excessive portion of the printing ink b that has been transferred to the contact roller 37 is fully removed from the contact roller 37 by means of the blade 45 or the like, thereby enabling restricting the occurrence of offsetting and strike-through in the printed paper, and also thereby preventing the printed image from being destroyed if the printed image side is rubbed with a fingertip immediately after discharge. Furthermore, the printing ink b forming the printed image dries faster.

The excess ink removing solution used in the present embodiment is a liquid which is incompatible with the printing ink forming the printed imaged on the printed image side of the printed paper P, and has a lower surface tension than the printing ink. For the liquid satisfying the above-described requirements, that is, a water solution of such a modified silicone oil as dimethyl silicone oil and phenyl, polyether, fluorine, amino, epoxy, carboxyl, carbinol, metacryl, melcapt, and phenol, added with a surface activator or an organic solvent.

As a surface-active agent to be added to water, anionic, cationic, and amphoteric ionic and nonionic surface-active agents are used. The amount of the surface-active agent to be added has been predetermined so that the surface tension of the excess ink removing solution will be lower than that of the printing ink.

An organic solvent to be added to water must be such an organic solvent incompatible with water as methanol, ethanol, isopropyl alcohol, n-propyl alcohol, ethylene glycol, and glycerin.

After the removal of the excessive ink, the surface-active agent is coated uniformly over the outer peripheral surface 37*a* of the contact roller 37; the thickness of coating is preferably about 0.0001 to 1 μm, which can be converted to about 0.1 to 100 mg/B4-size sheet in the amount of coating on the printed paper.

The contact roller 37, the counter roller 39, and the blade 45 are made of a material which will not subject to change in properties such as swelling. When a main component of the excess ink removing solution is for example silicone oil, it is desirable that the contact roller 37, the counter roller 39, and the blade 45 be produced of fluorine resin (rubber), phenyl modified silicone resin (rubber), and urethane rubber.

The contact roller 37 of the present embodiment is 1.5 or less in the coefficient of dynamic friction; preferably a contact roller of 0.2 or less in coefficient of dynamic friction is to be used. If the coefficient of dynamic friction exceeds 1.5, the cleaning means such as the blade which slides in contact with the contact roller will vibrate. Should the cleaning means vibrate, the excess ink removing solution including the printing ink would pass between the cleaning means and the contact roller, to smudge the printed paper.

Next, examples 1 to 5 which are other embodiments and comparison examples 1 and 2 will be explained.

EXAMPLE 1

Figure 2:
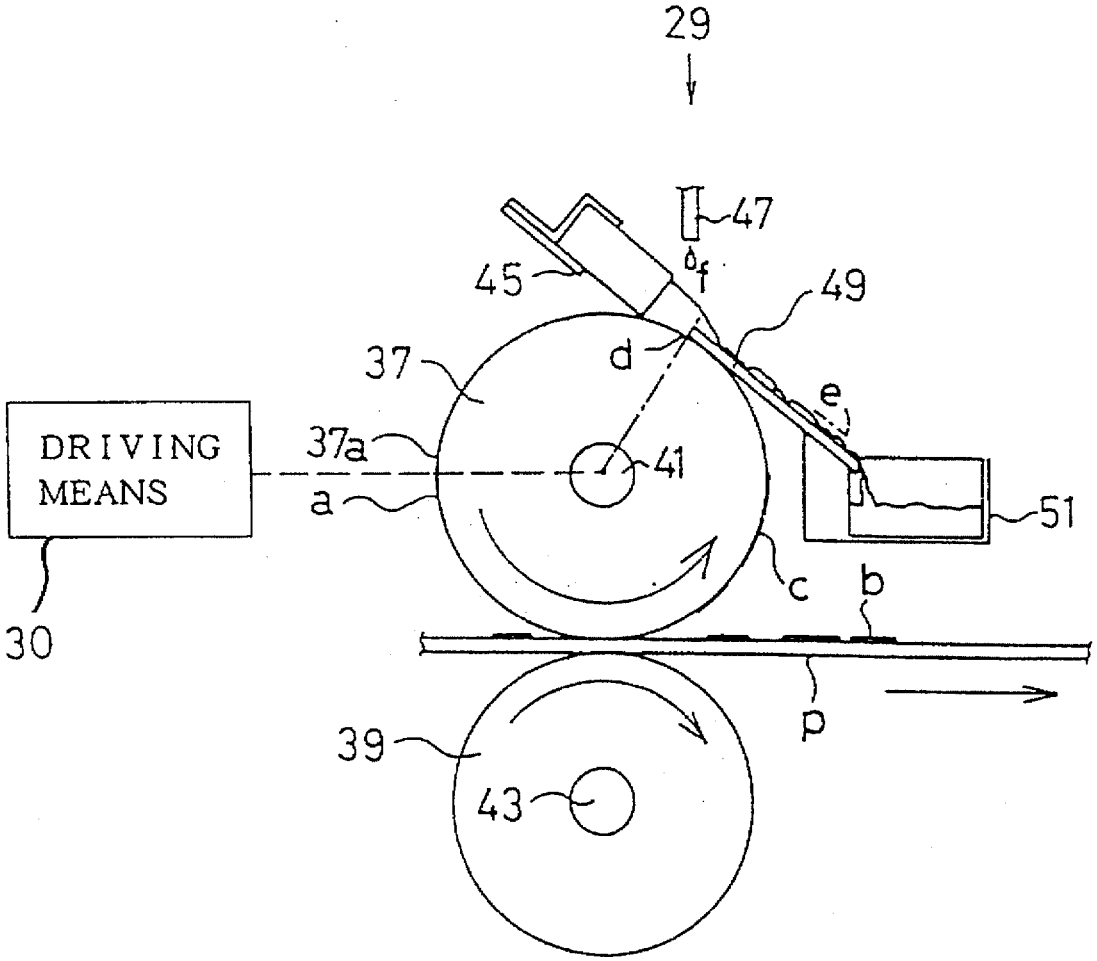
FIG. 2 is an enlarged view of the printed image after-processing apparatus in FIG. 1.

The apparatus of the present embodiment shown in FIG. 2 was adopted in a stencil printing machine (RISOGRAPH (registered trademark) RA205 manufactured by Riso Kagaku Kogyo Co., Ltd.). For the contact roller was used an aluminum roller polished after P.T.F.E. (tetrafluoroethylene) baking on the surface. The coefficient of dynamic friction of the contact roller surface at this time was 0.08.

For the excess ink removing solution, dimethyl silicone oil (KF-96, viscosity:100 cps produced by Shin-Etsu Chemical Co., Ltd.) was used. In stencil printing using this solution, the setting conditions of the blade 45 were adjusted so that the amount of coating of the excess ink removing solution would become 1 mg/B4-size sheet.

EXAMPLE 2

An apparatus similar to Example 1 was used. The aluminum contact roller with P.T.F.E. baked on the surface similarly to Example 1 was used after polishing. The polishing after baking was carried out under conditions different from Example 1 to obtain the 0.12 coefficient of dynamic friction. The excess ink removing solution used was similar to Example 1.

EXAMPLE 3

An apparatus similar to Example 1 was adopted. For the contact roller an aluminum roller was baked with P.F.A. (tetrafluoroethylene-perfluoroalkyl vinyl ether) on the surface and was treated at a temperature of 230° to 250° C. by using a heat-shrinkable tubing. The coefficient of dynamic friction of the contact roller surface of this example was 0.05. The excess ink removing solution employed was similar to Example 1.

EXAMPLE 4

An apparatus similar to Example 1 was used. For the contact roller a roller coated with silicone rubber (hardness: 60°) was used. The coefficient of dynamic friction of the surface of the contact roller of this example was 1.10. The excess ink removing solution employed was similar to Example 1.

EXAMPLE 5

An apparatus similar to Example 1 was used. For the contact roller, a polished aluminum roller was used. The coefficient of dynamic friction of the surface of the contact roller of this example was 0.25. The excess ink removing solution employed was similar to Example 1.

COMPARISON EXAMPLE 1

An apparatus similar to Example 1 was used. For the contact roller a roller covered with chloroprene rubber (hardness: 60°) was used. The coefficient of dynamic friction of the surface of the contact roller used in this comparison example was 1.60. The excess ink removing solution used was similar to Example 1.

COMPARISON EXAMPLE 2

An apparatus similar to Example 1 was used. For the contact roller a roller covered with nitryl butadiene rubber (hardness: 60°) was used. The coefficient of dynamic friction of the surface of the contact roller used in this comparison example was 1.80. The excess ink removing solution used was similar to Example 1.

Performance of each example and comparison example was evaluated according to the presence or absence of the phenomenon (removing performance) that the printed paper was smudged with excessive ink transferred from the contact roller back to the printed paper because of incomplete removal of the excess ink by the blade. A result of this evaluation is shown in FIG. 4. The coefficient of friction of the contact roller was measured by the use of HEIDON-14DR manufactured by Shinto Kagaku Co., Ltd. The measurement was conducted by moving a test sample of 40 mm-outside diameter roller under the conditions with 1.0 kg load and 50 mm/min speed of movement.

In the evaluation of the removing performance the marks O and X were used according to the following references.

O: The printing ink transferred to the contact roller 37 is removed completely by means of the blade 45. No re-transfer of ink to the printed paper occurred.

X: The printing ink transferred to the contact roller was not fully removed by the blade 45 and was re-transferred to the printed paper, smearing the printed paper.

Figure 3:
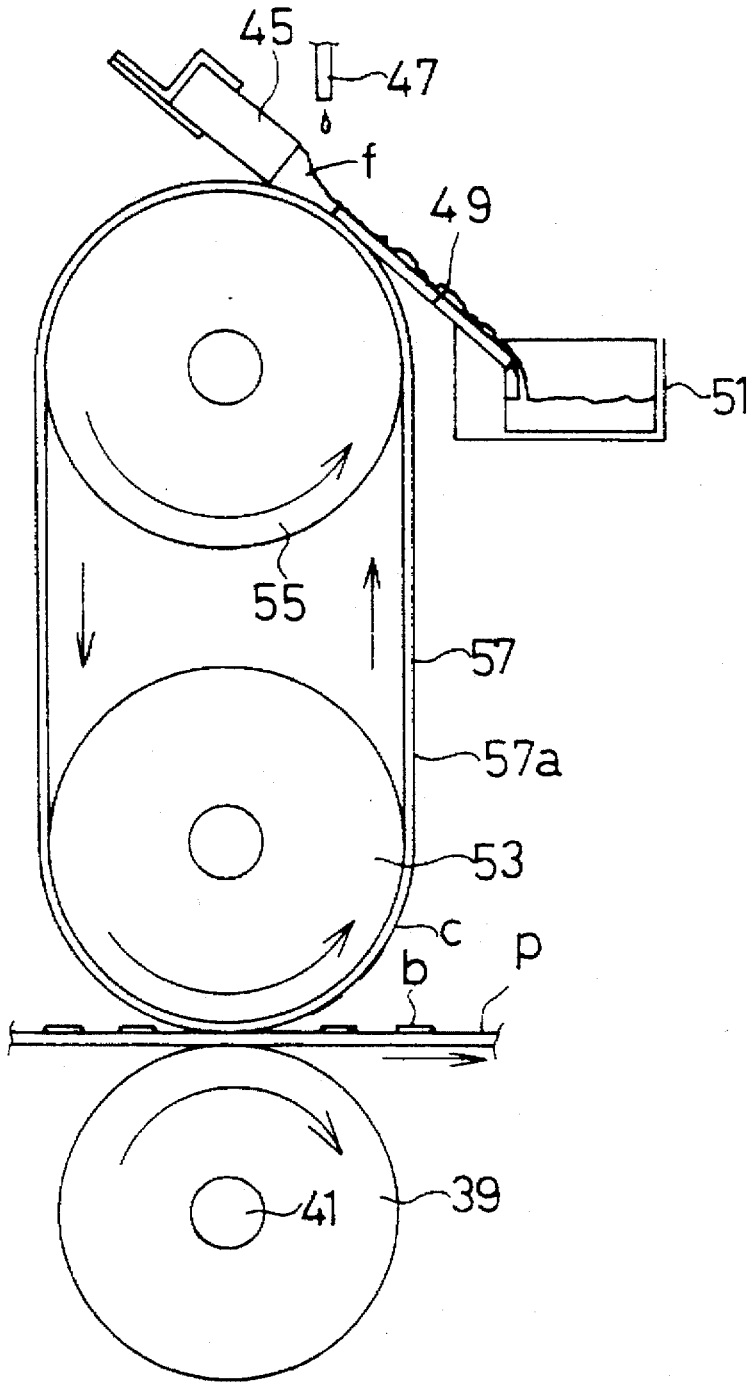
FIG. 3 is a view showing another example of constitution of the printed image after-processing apparatus in the present invention.

Next, another embodiment of the present invention will be explained with reference to FIG. 3. In FIG. 3, the same members as those in FIG. 2 are designated by the same reference numerals and are not explained. In this embodiment, a flexible endless belt 57 as a contact member is installed with a specific tension between two upper and lower rollers 55 and 53 disposed at a spacing. In this embodiment also an approximately same effect as the aforesaid embodiment is obtainable.

According to the present invention, the contact member coated on the surface with the excess ink removing solution contacts the printed image side of the printed paper, thereby fully removing the excessive portion of the ink forming the printed image on the printed paper. Therefore the occurrence of offset and strike-through and other troubles in the printed paper can be prevented, and further the printed image becomes hard to be impaired if the printed image side is rubbed with a fingertip immediately after printing.

Since the excess ink removing solution used in the present invention is a liquid which is incompatible with the printing ink forming the printed image and has a lower surface tension than the printing ink, ink that has been transferred to the layer of the excess ink removing solution is present afloat, that is, physically separate from the excess ink removing solution, on the surface of the excess ink removing solution layer. For removing this excessive ink from the contact member, the cleaning means that contacts the contact member with a 1.5 or less coefficient of dynamic friction is adopted, and therefore the excessive ink floating on the excess ink removing solution can be removed completely from the surface of the contact member. Consequently the printed image side of the printed paper will not be smudged.

What is claimed is:

1. A printed image after-processing apparatus, comprising:

supplying means for supplying excess ink removing solution, said excess ink removing solution being incompatible with printing ink forming a printed image on a printing sheet and having a lower surface tension than said printing ink;

a rotatable contact member having a coefficient of dynamic friction of 1.5 or less when the contact member is rotated, said excess ink removing solution being supplied from the supplying means to the contact member;

a counter member situated adjacent to the contact member, said counter member bringing a printed side of said printed sheet into contact with said excess ink removing solution on said contact member while conveying said printed sheet together with said contact member; and cleaning means which contacts said contact member to remove the excess ink removing solution with the excess printing ink.

2. A printed image after-processing apparatus according to claim 1, wherein said counter member is a counter roller which rotates oppositely to said contact member.

3. A printed image after-processing apparatus according to claim 2, further comprising means for collecting said excess ink removing solution contacting said contact member, said collecting means being located near the cleaning means before said contact member in a direction of rotation.

4. A printed image after-processing apparatus according to claim 3, wherein said contact member is a contact roller.

5. A printed image after-processing apparatus according to claim 3, wherein said contact member is a plurality of rollers, and an endless belt wrapped around the plurality of roller members.

* * * * *